United States Patent [19]

Schulz

[11] Patent Number: 4,530,282

[45] Date of Patent: Jul. 23, 1985

[54] PRINTING ATTACHMENT AND PRINTING METHOD

[76] Inventor: Jürgen Schulz, Bergiusstrasse 32-34, Berlin 44, Fed. Rep. of Germany, D-1000

[21] Appl. No.: 610,599

[22] Filed: May 15, 1984

[30] Foreign Application Priority Data

May 16, 1983 [DE] Fed. Rep. of Germany ..... 3317746

[51] Int. Cl.[3] ..... B41F 13/28; B41F 23/40

[52] U.S. Cl. ..... 101/177; 101/181; 101/182; 101/247

[58] Field of Search ..... 101/174, 175, 176, 177, 101/178, 179, 180, 181, 182, 183, 184, 185, 219, 220, 221, 247, 216, 217, 218, 132, 136, 137, 138, 139, 140, 142, 143, 144, 145

[56] References Cited

U.S. PATENT DOCUMENTS 3,329,086 7/1967 Pullen ..... 101/247

3,366,049 1/1968 Nystrand ..... 101/247

4,301,728 11/1981 Jaffe et al. ..... 101/218

4,384,522 5/1983 Ehlers et al. ..... 101/247

*Primary Examiner*—J. Reed Fisher

*Attorney, Agent, or Firm*—Holman & Stern

[57] ABSTRACT

A printing attachment for a rotary printing press comprises first and second cooperating cylinders rotatably mounted on respective first and second shafts. The first shaft is supported by holding devices for movement by a power operated device and the second shaft is mounted on a frame. Each shaft has at each end a support member, such as an annular or disc-shaped member, which faces a respective support member on the other shaft. Each support member on the first shaft can be brought into contact with a respective support member on the second shaft as well as into contact with one of a pair of parallel arranged further support members, at spaced positions along the first support members, by the power operated device to engage the first cylinder. The position of at least one pair of support members is adjustable to alter the operating position of one cylinder relative to the other.

24 Claims, 12 Drawing Figures

FIG.9
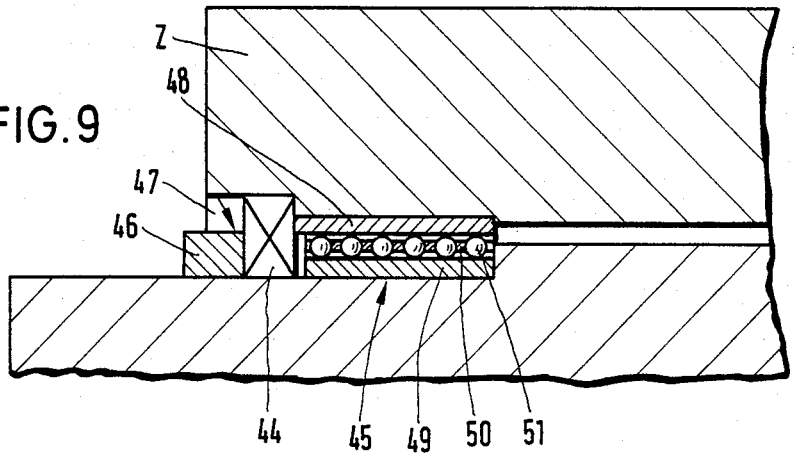
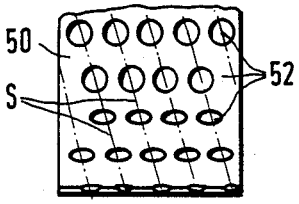
FIG.10
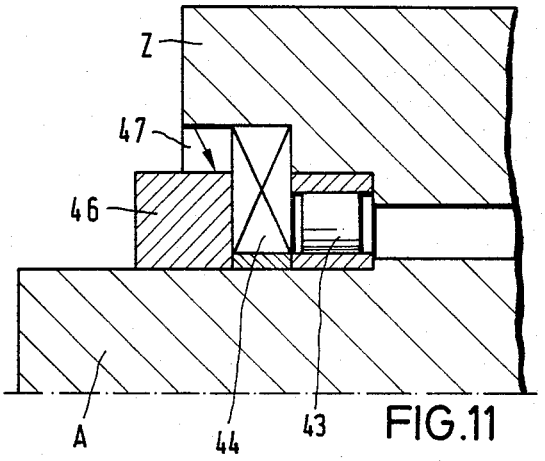
FIG.11
FIG.12
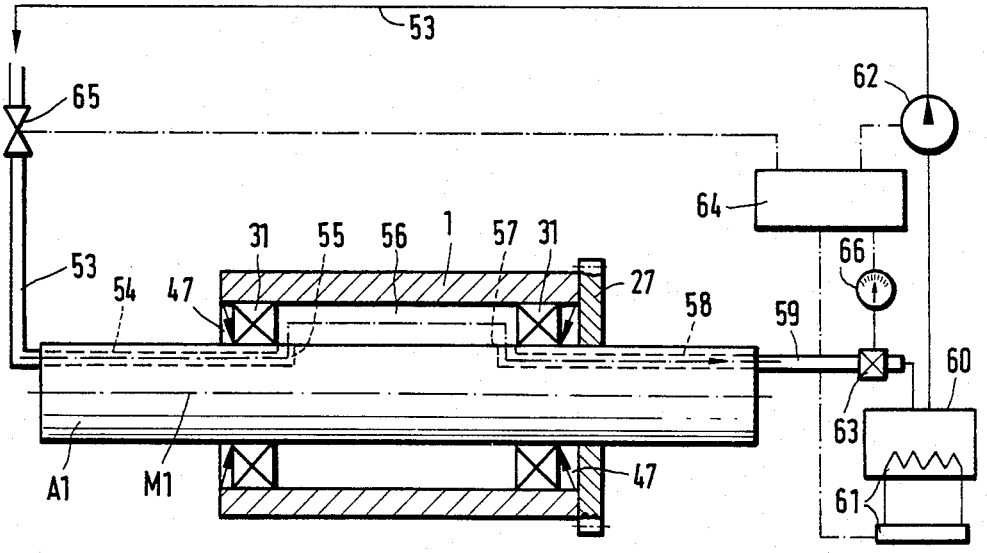

PRINTING ATTACHMENT AND PRINTING METHOD

BACKGROUND OF THE INVENTION

The invention relates to a printing attachment for rotary printing presses, in particular for indirect letterpress printing, such as dry offset or the like, having cylinders interposed between parts of the frame, a first and a second cooperating cylinder having associated with them at each of their ends a support member, e.g. an annular or disc-shaped support member, held independently of the rotation of the cylinders, and outer support surfaces on two support members which in each case face one another.

In the case of a known printing attachment (German Gebrauchsmuster [Utility Model] No. 79 18 882) the lateral journals of the forming cylinder and of the rubber cylinder of an offset printing press are mounted by rolling bearings in lateral frames. Bearing rings are secured on the journals outside the latter, while support rings, which do not participate in the rotation of the cylinders, are mounted on the journals inside the walls. In the case of one of the two cylinders the main bearings are arranged in bushes with an eccentric outer surface, which may be rotated in corresponding receiving bores in the lateral frame and may be fixed in a position in which a desired prestressing force is produced in each case. The two cylinders are thus pressed towards one another in conventional manner. The purpose of such a design of the printing attachment should be to provide a support for printing attachment cylinders which performs an operation corresponding to the bearing ring operation, but provides better repair conditions.

In the past it was generally assumed in the printing industry that in principle all cylinders of a printing attachment must be pressed against one another with a specific force. This likewise applies to different printing methods. As stated for example in the paper "Die 'Kiss-print-Methode' im Offsetdruck" [The kiss-print method in offset printing], in the journal "Der Polygraph" [The polygraph], 23–80, p. 2161, a "proper pressure" or "compressive stress" is considered necessary for the process of ink transfer in the printing press, namely between all the cylinders of the printing attachment. Here the established opinion is expressly stated that the processes of ink acceptance and ink transfer must take place at a specific pressure or can only be correctly carried out under pressure. A slight contact of the inked printing plate and the rubber blanket would not be sufficient. The so-called kiss print impression, in which a trouble-free pressing out of the surface is made possible, should be between an excessive and an insufficient impression. This would be a proper, adequate contact between the cylinders and not merely a rapid, superficial contact. Calibrated base sheets, coatings etc. are mentioned as auxiliary means for attaining such a sufficient pressure between the cooperating cylinders. This means, however, that the pressure which should be necessary, according to current practice to form a good printed image must be produced in the case of difficult work.

In the case of the invention it has been recognized that current practice is not suitable for solving the problem of the correct ink transfer and trouble-free printing. The pressures generally thought to be necessary and applied in the case of cooperating cylinders lead to so-called wearing bands, i.e. flat pressure surfaces on the cylinders, with a width of from 0.6 to 0.7 mm for example in the case of a cylinder diameter of approximately 200 mm. It has been found that in the case of cylinders which are applied to one another with such pressure or a similar pressure there is a squeezing away of the ink from the "point", so that at least to a large extent the ink does not stay where it should in fact be, but is pushed aside into the periphery of this point. This explains, in the case of indirect letterpress printing for example, a reduced brilliance of the ink, a dull or pale image or the like. According to the teaching of the invention it is therefore correct for the ink, as it moves from one cylinder to the other during the transfer, to be kept or concentrated only on the "spot", i.e. at the position which actually belongs to the regular printed image in the same way as innumerable other ones and is to contribute to the printed result. Only in the case of a printing method which can carry this out is it possible correctly to speak of a kiss-print method.

By means of the invention it should be possible to solve as far as possible the problems discernable from the above.

DESCRIPTION OF THE INVENTION

An object of the invention is to provide the preconditions for an actual kiss-print impression and thus for a trouble-free printed result, in particular for indirect letterpress printing, but also for other printing methods in which difficulties have formerly arisen when producing a trouble-free printed image, in particular with respect to ink transfer. It is desired, in the case of two cooperating cylinders, in particular a forming cyliner and a transfer cylinder, to apply the ink as far as possible to the "point" or primarily to concentrate it there and to transfer it while maintaining this condition, in order to achieve a correspondingly good result in this way.

This is achieved by dispensing with the previously customary pressings between two cylinders with the resulting wearing bands, where appropriate with the exception of the relationship between an impression cylinder and a transfer cylinder in the case of a printing attachment for offset or dry offset. For this purpose a printing attachment is provided according to the invention, in which the important cylinders are provided with a high degree of accuracy and in which precise adjustment is possible.

The invention resides in a printing attachment for rotary printing presses, comprising:

- a frame having frame parts;
- a first shaft;
- holding devices in which the ends of the first shaft are detachably held for movement relative to the frame;
- a first cylinder rotatably mounted on the first shaft by means of rolling bearings and interposed between the frame parts;
- a first pair of support members supported by the first shaft at opposite ends respectively of the first cylinder so as to be independent of rotation of the first cylinder;
- a second shaft detachably mounted on the frame parts;
- a second cylinder rotatably mounted for cooperation with the first cylinder on the second shaft by means of rolling bearings and interposed between the frame parts;

a second pair of support members supported by the second shaft at opposite ends respectively of the second cylinder so as to be independent of rotation of the second cylinder, the first and second support members having respective outer supporting surfaces which face one another;

a third pair of support members having support surfaces disposed parallel to one another;

a power operated device for moving the holding devices to move the support surfaces on the first support membes into contact with the support surfaces on respective second and third support members at a distance from one another in the manner of a two-point abutment and out of contact therewith to respectively engage and disengage the first cylinder;

and means for adjusting the position of the support surfaces of at least one pair of support members.

Thus a printing attachment is provided which is characterized by a number of essential advantages. As a result of its precision and the possibilities of adjustment the kiss-print method may actually be carried out in its true concept. It permits a trouble-free ink transfer and thus makes possible an excellent printed result. Depending upon the printing method and the nature of the ink there need not be a firm contact between the cooperating cylinders, but in the initial state there may theoretically be a gap of some micrometers in size.

In the case of a printing attachment for indirect letterpress printing, offset or a similar method the above mentioned first cylinder is advantageously a transfer cylinder and the second cylinder is a forming cylinder.

The support members may have any shape which is suitable for a trouble-free positioning of the parts of the system within the framework of the invention. In this way plates, extension pieces, arms, blocks and similar elements may be provided which have, as support surfaces, suitable surfaces for abutting against the members opposite in each case. The support members, however, are advantageously in the form of rings or discs, in particular with a cylindrical peripheral surface, where appropriate however also with flat portions.

A pair of support members is meant to indicate those which are disposed parallel and at an axial distance from one another, for example the support members associated with the second cylinder and disposed at both ends thereof. The adjustability of the position of the support surfaces represents a variability of the radial position of the respective support position for the abutting support member with respect to the axis of the associated cylinder (turning centre) or, if support members without an associated cylinder are involved, with respect to an assumed line or axis orientated essentially parallel to a cylinder axis. In the case of a pair of associated support members the position of the support surfaces themselves is preferably adjustable independently of one another. Mutual adjustability, however, is not excluded.

In an advantageous embodiment there are provided on the first cylinder, support members, the support surfaces of which are disposed at a fixed distance from the rotational axis of the cylinder, namely in the form of rings or discs secured to the shaft of the cylinder and having a cylindrical peripheral surface as a support surface. Support members with a variable position of the support surfaces are then associated with the second cylinder. In the case of the further support members, each forming the second bearing point for the support members of the first cylinder, the position of the support surfaces may be either fixed or variable as well, depending upon the circumstances or the design of the printing attachment. The latter alternative applies in particular to a highly advantageous embodiment of the printing attachment, in which the further support surfaces are associated with a third cylinder which cooperates with the first cylinder. This third cylinder is advantageously a forming cylinder. If the second cylinder is also a forming cylinder, this represents a particularly advantageous embodiment of a printing attachment for indirect letterpress printing, in which the two forming cylinders then cooperate with a transfer cylinder, namely with different peripheral areas thereof.

Where a third cylinder is present, it is also advantageously rotatably mounted by rolling bearings on a shaft, the support members being supported by this shaft.

An advantageous embodiment with the possibility of adjustment lies in the fact that at least one support member may be set at an angle about an axis of rotation by means of a setting apparatus and comprises a support surface arranged eccentrically to the said axis of rotation. In the case of support members which are associated with a cylinder, the axis of rotation is preferably the same as the turning centre of the cylinder. In this connexion the support member is advantageously rotatably mounted on the cylinder shaft, in particular by means of a prestressed rolling bearing. When a support member is securely mounted on a cylinder shaft, the shaft itself must, however, be held rotatably in the frame of the printing attachment. The expression "eccentric" is to be taken in the widest possible sense. It may be a cylindrical support surface, the geometrical axis of which is offset by a certain eccentricity, in particular in the order of magnitude of some tenths of a millimeter, namely from 0.2 to 0.5 mm, with respect to the axis of rotation of the support member or a component supporting the latter. This expression should also embrace those peripheral surfaces whose distance from the axis of rotation varies continuously, e.g. following a spiral, or where appropriate in stages.

An advantageous embodiment of a setting apparatus for a support member rotatable at an angle comprises a worm gear drive, the worm wheel of which is connected rotationally rigidly to the support member. An apparatus of this type permits a very fine setting of the support member with its support surface and hence of the relative position of the cylinders. In the case of a highly advantageous embodiment the worm of the worm gear drive is supported on the side remote from the worm wheel on two pressure members which are acted upon by springs, namely plate springs, which seek to move them apart. In this way the worm is constantly pressed into the paths of the worm wheel and the worm gear drive is held in a simple manner without play so that precise adjustments are possible in both directions. By virtue of application in a setting apparatus for a support member such a design of a worm gear drive is important in its own right, in particular for other displacement or setting devices in the case of printing presses.

In a further development of the printing attachment the invention provides that the ends of the shaft of the first cylinder are received by fork-shaped ends of two pivot levers, which are mounted on parts of the frame and the other ends of which are connected to the power-operated device used to move the lever and thus the cylinders. The pivoting points of the levers are the region between their ends, advantageously at points such that the cylinder shaft or the support members carried thereby are moved essentially symmetrically to the two bearing points.

Furthermore the printing attachment may be arranged such that there is associated with the first cylinder a impression cylinder with support members which are intended for bearing against the support members of the first cylinder, the impression cylinder being movable with respect to the first cylinder so as to engage and disengage the first cylinder. Such an embodiment may be considered for various printing operations. It is particularly suited for a printing attachment for indirect letterpress printing, the first cylinder then being a transfer cylinder. The impression cylinder is advantageously likewise rotatably mounted on a shaft with rolling bearings, the support members being carried by the said shaft, either by way of a fixed connexion or by using a pivot bearing. The latter is taken into consideration in particular when adjustable support members are involved, as is advantageous in many cases. An advantageous embodiment then lies in the fact that the support members of the impression cylinder comprise support surfaces extending eccentrically to the turning centre of the cylinder and are adjustable at an angle about the turning centre. What has been stated previously in connexion with the concept of the eccentric path and the setting device applies here accordingly.

The impression cylinder may in particular be held in two levers which are pivotable by a power-operated device so as to engage and disengage the impression cylinder. It is advantageously arranged that a device for moving the first cylinder and a device for moving the impression cylinder may be actuated one after the other in a predetermined sequence by means of a control device. This may also be carried out automatically by means which are available to the person skilled in the art.

In the case of a cylinder mounted by rolling bearings on a shaft the rolling bearings are advantageously prestressed. This further contributes to an increase in accuracy. A particularly advantageous embodiment of a rolling bearing for the cylinder bearing consists in the fact that the rolling bearings are arranged in a helical line at a distance from one another in a cylindrical cage. The bearing may then be further provided with an outer ring and an inner ring in conventional manner.

According to a further feature of the invention. where there is at least one cylinder, flow paths for a medium are provided for controlling the temperature. A medium of this type is, in particular, oil. In this way the cylinder may if necessary be cooled or, in the starting phase of the printing press for example, may also be heated, so that during operation an at least largely constant temperature may be observed, which is of benefit for accuracy.

An advantageous embodiment consists in particular in the fact that in both ends of the shaft of a cylinder bores are provided which open out in the vicinity of the bearing of the cylinder into the inner space between the cylinder and the shaft, the cylinder being sealed off from the outside at both its ends. A control or regulating device is advantageously provided in order to observe a predetermined temperature of the medium conveyed through the cylinder. This may be a common device for a plurality of cylinders. What is particularly advantageous, however, is to provide a separate device for each temperature-controlled cylinder.

The invention further resides in a method of producing a cylinder for a printing press of the type described above, which consists in the fact that the cylinder is mounted with rolling bearings on the shaft, in particular while fitting the bearing while being prestressed, and that the cylinder is accordingly ground upon its peripheral surface while rotating about the shaft which is rigidly clamped. The shaft may be clamped in conventional manner on a grinding machine. On account of such a machining of the cylinder in its finally mounted state upon the shaft an extremely high degree of accuracy with respect to its shape and also a corresponding surface quality is achieved. Such a method is independently important for roller-mounted cylinders or rollers in maunfacturing the printing press.

The invention will now be more particularly described, by way of example, with reference to the accompanying drawings, in which:

DESCRIPTION OF THE DRAWINGS

FIG. 9 is a section of a cylinder bearing;

FIG. 10 is a partial view of a support member of the bearing according to FIG. 9;

FIG. 11 is a section of another embodiment of a cylinder bearing and

FIG. 12 is a section of a cylinder with temperature control.

DESCRIPTION OF PREFERRED EMBODIMENTS

Figure 1:
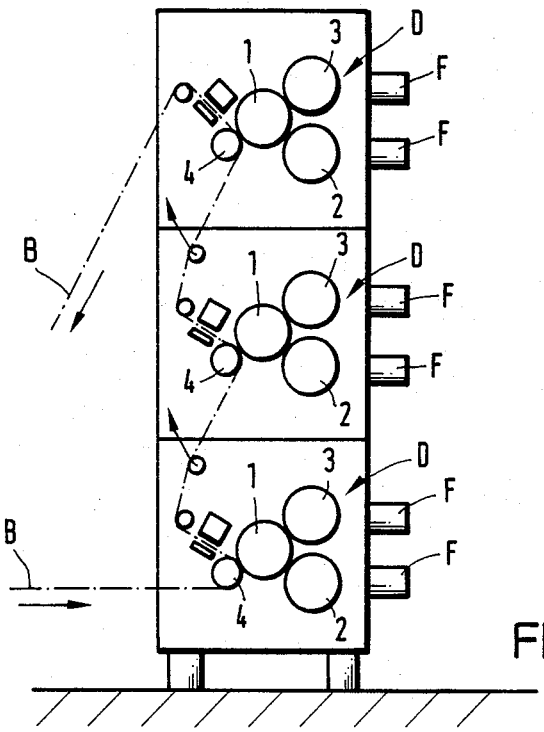
FIG. 1 is a partially diagrammatic side view of a printing press with a plurality of printing attachments according to the invention.

A printing press for indirect letterpress printing, which is provided with three printing attachments D designed according to the invention, is illustrated in FIG. 1. In this way a web B passing through the printing attachments in succession and indicated in dash-dot lines is printed in six colours. Each printing attachment contains a transfer cylinder 1, two forming cylinders 2 and 3 cooperating therewith and an impression cylinder 4 cooperating the the transfer cylinder at another point. The letter F designates inking devices associated with the forming cylinders in each case. The web B may be for example a multi-layer web for stick-on labels, in which a punching operation and where necessary other processing operations are further carried out subsequently to the printing procedure. The web B may be moved by devices not covered by the invention in the region of the printing press in such a way that continuous overprints are produced on the web, although the transfer cylinder has a surface intended for printing only on parts of its periphery, the forming cylinders being designed accordingly and being provided with printing plates, in such a way that these areas are formed on the transfer cylinder. There may be for example two areas intended for printing on each transfer cylinder 1. Arrangements to make a web move intermittently in the manner required, are familiar to the person skilled in the art.

Figure 2:
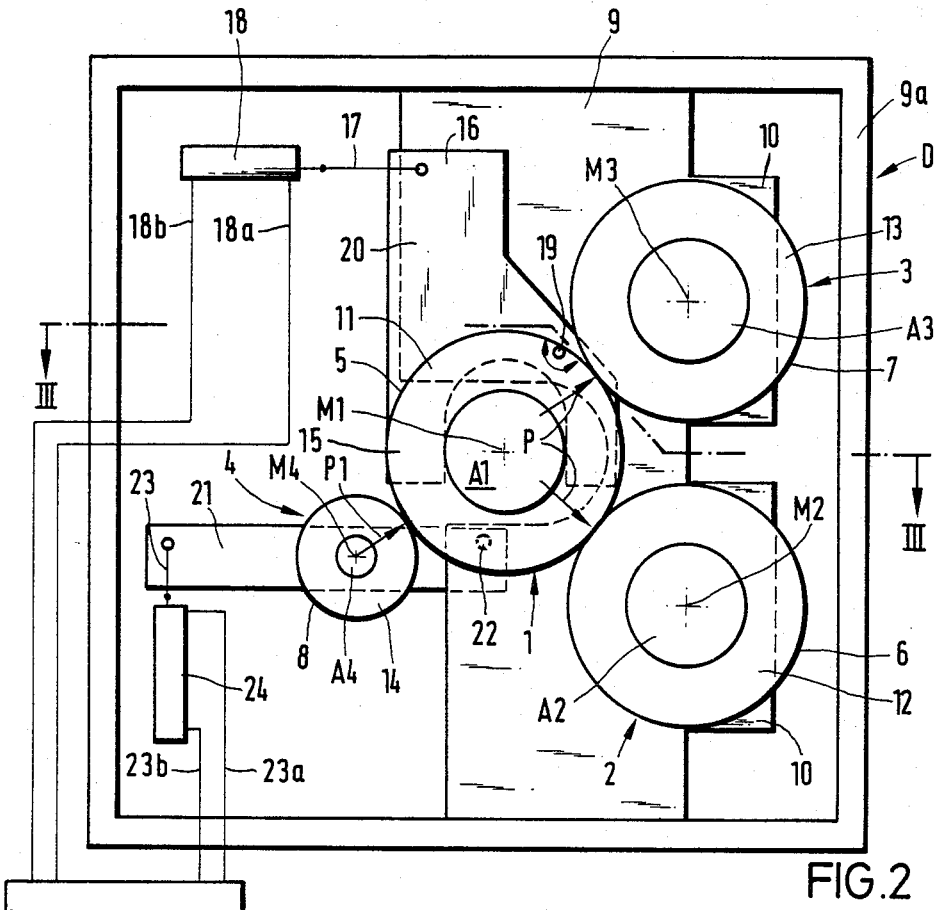
FIG. 2 is a side view of an embodiment of a printing attachment according to the invention, some parts being omitted for the sake of clarity.
Figure 3:
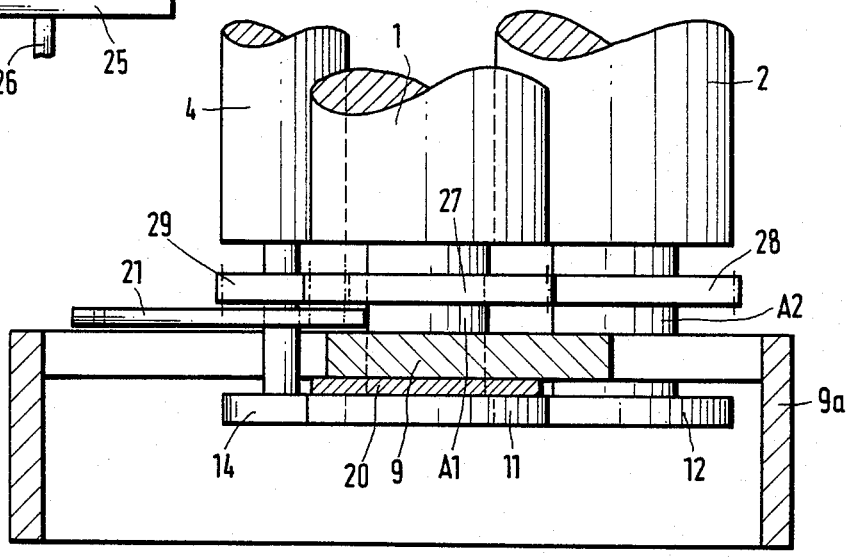
FIG. 3 is a section along the line III—III in FIG. 2.

A single printing attachment is shown on a larger scale in FIGS. 2 and 3. All four cylinders 1, 2, 3 and 4 have non-rotatable shafts A1, A2, A3 and A4, on which the actual cylinders, i.e. cylinder jackets, are mounted with rolling bearings. This will be explained in greater detail below.

Annular support members 11, which comprise cylindrical peripheral surfaces as support surfaces 5, are secured to the ends of the shaft A1 of the transfer cylinder 1. The radius of these support members 11 is essentially equal to the radius of the cylinder itself, both parts having the same central axis M1.

The shafts A2 and A3 of the cylinders 2 and 3 are secured in frame portions 9 of the printing attachment with screwed-on holding members 10. The shaft A2 has at each end a support member 12 with a support surface 6 on the periphery and the shaft A3 has at each end a support member 13 with a support surface 7 on the periphery. The arrangement and the design are such that at each end of the cylinder shafts the support members 12 and 13 form a two-point abutment for the support members 11 of the transfer cylinder 1. The two support points are indicated by the arrows P in FIG. 1.

The transfer cylinder 1 is allowed to move so as to engage or disengage with the forming cylinders 2 and 3. In the case of the advantageous embodiment according to FIGS. 2 and 3, pivot levers 20, only one of which is visible in the drawing, are provided in this connexion on each side of the printing attachment. Each pivot lever 20 comprises a fork-shaped end 15, by means of the opening of which it embraces the shaft A1 of the transfer cylinder 1. A power-operated moving device 18, which consists in particular of one or more pneumatic cylinders, engages on the other end 16 of the pivot lever 20 by way of a connecting rod 17. The numerals 18*a* and 18*b* designate the air connexions of a cylinder of this type. The pivot point 19, e.g. a stable pivot bearing, for the lever 20 is arranged in the area between the ends of the latter in such a way that the shaft A1 together with the parts which it supports moves approximately symmetrically to the shafts A2 and A3 of the cylinders 2 and 3 when the device 18 is actuated. The latter is double-acting, so that a guided displacement may take place in both directions. In the operating position the devices 18 which are acted upon produce such a force that the support members 11 of the cylinder 1 are firmly pressed against the support members 12 and 13 of the cylinders 2 and 3. The shaft A4 of the impression cylinder 4 bears support members 14 with support surfaces 8 and is detachably secured at each end in a lever 21. Each of these two levers 21 is pivotably mounted at one end on a stable pivot bearing 22. The pivot bearings 19 and 22 for the two pairs of levers 20 and 21 are on the frame portions 9 on both sides. A further power-operated displacement device 24, which preferably consists of one or more double-acting pneumatic cylinders, engages on the other end of each lever 21 by way of a connecting rod 23. The numerals 23*a* and 23*b* designate the air connexions with the associated leads. The levers 21 may be pivoted jointly in one and the other direction by means of the device 24, in order to engage the impression cylinder 4 with the transfer cylinder 1 or to disengage it therefrom. In this way the support surfaces 8 of the support members 14 engage on the support surfaces 5 of the support members 11. The support point is indicated in FIG. 2 by the arrow P1.

The numeral 25 in FIG. 2 designates a common control apparatus for the displacement devices 18 and 24, to which a main supply line 26 for the pressure medium leads. This control apparatus is designed with components available to the person skilled in the art such that when it is actuated the impression cylinder 4 is first disengaged from the transfer cylinder 1 and the transfer cylinder 1 is then disengaged from the forming cylinders 2 and 3, or, vice versa, the transfer cylinder 1 is first engaged with the forming cylinders 2 and 3 and then the impression cylinder 4 is then engaged with the transfer cylinder 1. Engagement is to be understood to mean that the support surfaces of the support members 11, 12, 13 and 14 are in fixed mutual abutment in each case. The procedures described may take place completely automatically on a command signal. The path during disengagement, i.e. during movement apart of the cylinders in question, may be relatively small. It is advantageously only of such magnitude that gearwheels associated with the cylinders do not come completely out of engagement. Gearwheels 27, 28 and 29 associated with the cylinders 1, 2 and 4 are shown in FIG. 3. In the same way the cylinder 3 is provided with a gearwheel which is in engagement with that of the transfer cylinder 1. The driving movement for the cylinders is initiated by a motor or gearing (not shown) in a suitable manner in one of the gearwheels in mesh engagement with one another, whereby all four cylinders are made to rotate.

The two parts 9 of the frame, which are provided with frame-like flanges 9*a* and between which the cylinders are disposed, are rigidly connected together by transverse members, ties or other suitable members (not shown). Only one of these parts 9 of the frame is visible in each case in FIGS. 2 and 3. In the embodiment illustrated the support members 11, 12, 13 and 14 are disposed outside the parts 9 of the frame. In a modified embodiment, however, they may also be interposed between the parts of the frame or walls of the printing attachment.

Figure 4:
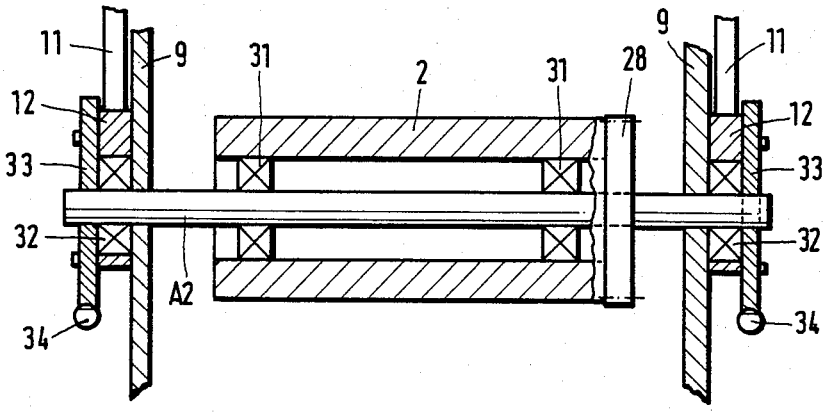
FIG. 4 is an axial section of a cylinder with adjustable support members.
Figure 5:
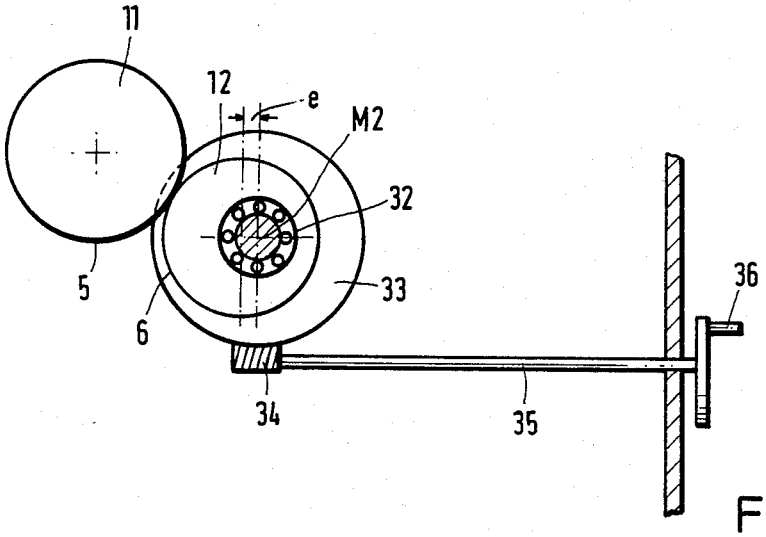
FIG. 5 is a partially diagrammatic side view corresponding to FIG. 4.
Figure 6:
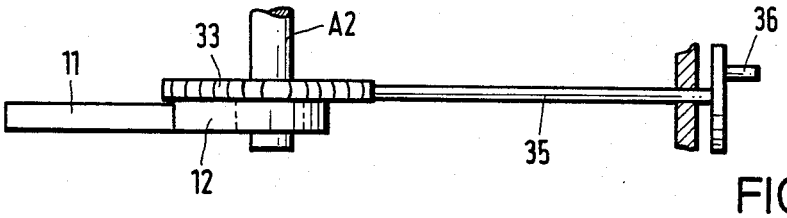
FIG. 6 is a plan view corresponding to FIG. 5.

In the case of the two forming cylinders 2 and 3 the position of the support surfaces 6 and 7 of the support members 12 and 13 may be adjusted in each case relative to the geometrical median axis (turning centre) M2 and M3 and in this way the operating position of the transfer cylinder 1 may also be adjusted relative to the forming cylinders 2 and 3. An advantageous embodiment of such adjustability is shown in FIGS. 4 to 6 with reference to the example of a forming cylinder 2. In this connexion, FIG. 4 also shows that the actual cylinders 2 (in practice in the form of a cylinder jacket) is mounted by rolling bearings 31 on the shaft A2. The latter is non-rotatably fixed in the parts 9 of the frame. The support members 12 are mounted by rolling bearings 32 on the ends of the shaft A2 and are rotationally rigidly joined to worm wheels 33 with which worms 34 engage. Each worm may be rotated by way of a control shaft 35 carrying a crank handle 36 at its end and thus, by way of the worm wheel 33, it causes the support member 12 to rotate about the geometrical centre M2 of the shaft A2. Each of the two support members 12 has a cylindrical support surface 6 which forms the abutment for the support member 11, but the support members are arranged eccentrically to the centre M2 of the shaft A2 by an amount e. The degree of eccentricity may lie, in particular, in the range of a few tenths of a millimeter. In this way, and as a result of the stepped-down ratio produced by the worm gear drive 33 and 34, an extremely precise adjustment of the position of the support surface 6 relative to the geometrical centre M2 of the cylinder 2 is made possible.

Figure 8:
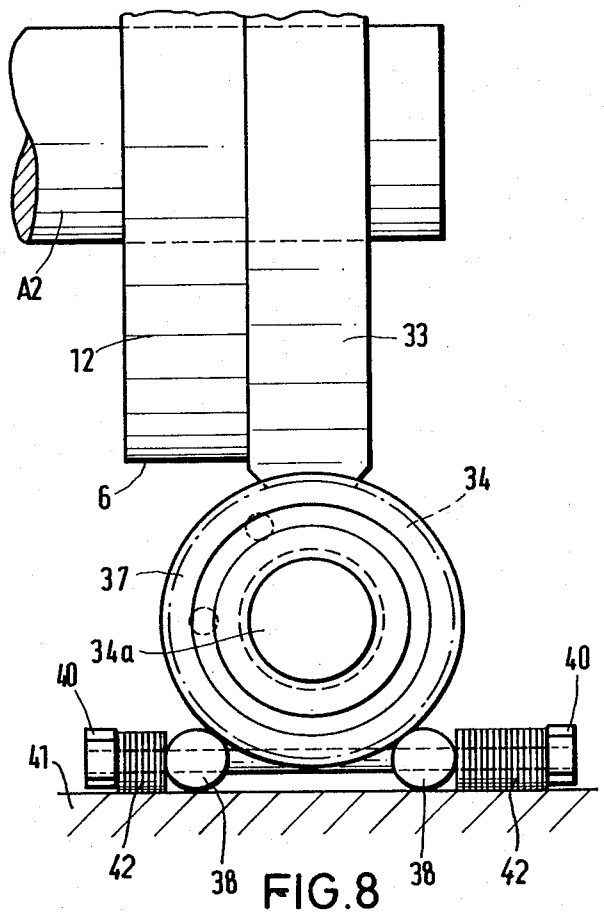
FIG. 8 is a front view corresponding to FIG. 7.
Figure 7:
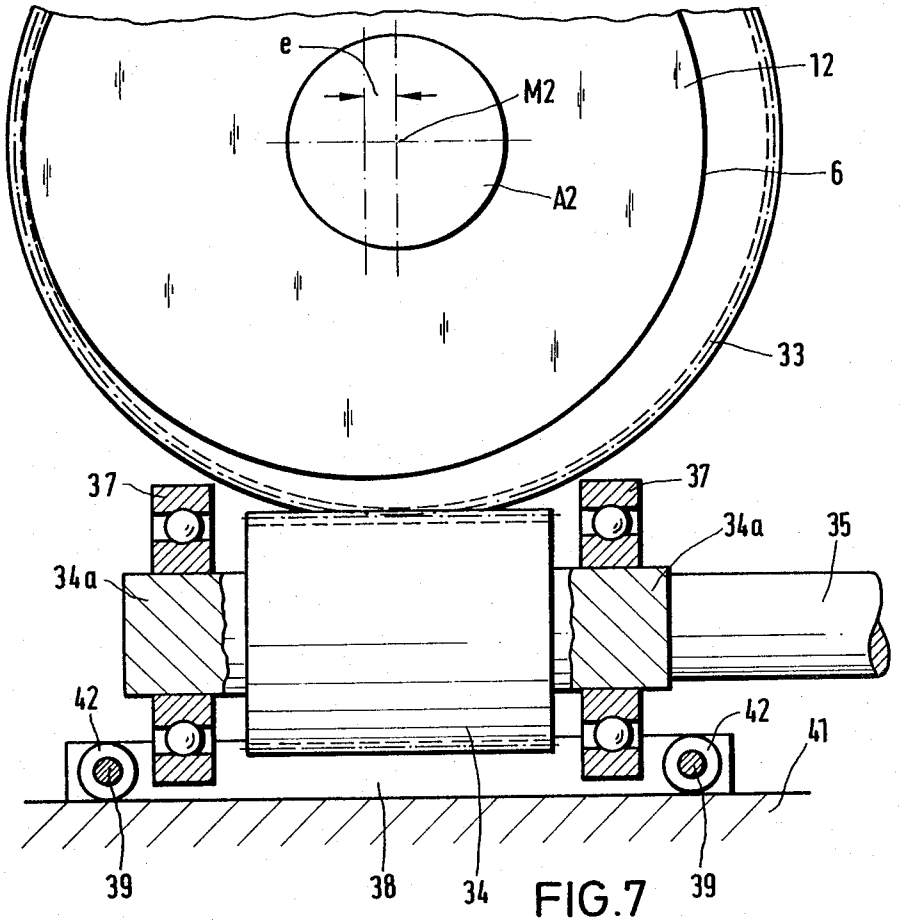
FIG. 7 shows part of a control drive for a support member on an enlarged scale, partially in a side view and partially in an axial section.

FIGS. 7 and 8 show a highly advantageous embodiment of a worm gear drive, as particularly envisaged for the control apparatus described above, but which may also be advantageously used in other cases. In this connexion the worm 34 is mounted by journals 34*a* at its ends in rolling bearings 37, the outer rings of which on the side remote from the worm wheel 33 are supported on two pressure members 38. These pressure members are advantageously cylindrical pins which are held displaceably on continuous journals 39. These journals 39 are received in end pieces 40, which are secured for example by screws to a base, bracket 41 or the like or, however, may be supported in merely a sliding manner on such a base. Sets of plate springs 42, which are guided on the journals 39, are interposed in each case between the end pieces 40 and the pins 38. In this way the pins 38 are pressed towards one another and so in turn press the threads of the worm 34 into the worm toothing of the worm wheel 33 by way of the rolling bearings 37. An engagement without play is thus made possible in a simple manner, so that a precise displacement movement is made possible in both directions. A support member 12, which is arranged eccentrically to the turning centre M2 and which is connected to the worm wheel 33 is also shown in FIGS. 7 and 8.

It is advantageous to be able to adjust the position of the support surfaces in the case of the second forming cylinder 3 as well. It may advantageously also be made possible in the case of support members of the impression cylinder 4. In this connexion the control apparatus may be designed in the same or a similar way, as was explained above in conjunction with FIGS. 4 to 8. However, other embodiments of support members and control apparatus are also possible. This has already been explained in another passage.

All four cylinders 1, 2, 3 and 4 of the printing attachment are advantageously provided with rolling bearings on a fixed shaft, as shown in principle in FIG. 4 for the cylinder 2 (rolling bearing 31, e.g. as a combined axial and radial bearing). The rolling bearings of the cylinder bearings are advantageously prestressed or are fitted in such a way as to produce prestressing. This may for example be carried out by assembling a bearing with a suitable excess dimension while it is pressed into the prepared seating on the axis and on the cylinder or by inserting a bearing of this type after previous intense cooling of the shaft or by heating the cylinder or in another suitable manner available to the person skilled in the art.

A particularly advantageous embodiment of a cylinder is illustrated in FIGS. 9 and 10. In this connexion a cylinder Z is mounted on a shaft A by means of an axial bearing 44 and a radial bearing 45. The axial bearing 44, for example a ball bearing, is held by a nut screwed on to a thread on the shaft A or by a ring 46 having an under-dimension. The numeral 47 designates a retaining ring or a similar seal. The radial bearing 45 has an outer ring 48, an inner ring 49 and a cylindrical cage 50 with balls 51 as rolling bearings, there being the special feature that the receiving holes 52 for the balls 51 are formed in the cage 50 and so the balls 51 themselves are disposed on a helical line S with a plurality of windings. Irrespective of this the balls 51 may each be arranged in a row in the direction of the surface lines of the cage 50, as shown in FIG. 10, or, on the other hand, may be arranged offset relative to one another in this direction. On account of the helical arrangement of the rolling bearings a plurality of paths offset axially with respect to one another is produced. A bearing arrangement of this type has proved to be highly advantageous. The cage 50 may consist of metal or another material suitable for this purpose.

FIG. 11 shows an embodiment in which the cylinder Z is mounted on the axis A on each side with one axial bearing 44 and one radial bearing 43 of a different type, for example a roller bearing or needle bearing. Here too the numeral 46 designates a ring or a nut for securing the bearings and the numeral 47 designates a seal.

An embodiment of the transfer cylinder 1 is shown in FIG. 12 by way of example, in which means are provided for controlling the temperature. The shaft A1 is provided at both ends with bores 54 and 58 which extend parallel to the geometrical longitudinal axis M1 and which are each connected behind the bearings 31 by radial bores 55 and 57 to the inner space 56 of the cylinder. This space is closed outside the bearings 31 by seals 47. A medium, in particular oil, which is conveyed through a line 53 flows, as indicated by the dash-dot lines, through the bores 54 and 55 into the inner space 56 and from there through the bores 57 and 58 to a line 59 which leads to a tank 60 with a cooling and/or heating device 61. From there the medium can be fed back into the line 53 by means of a pump 62. In the discharge line 59, where appropriate also immediately in or at the end of the bore 58, there is a temperature sensor 63, which is connected to a regulating device 64. By means of the latter either a valve 65 provided in the supply line 53 may be closed or opened by means of a servo drive or may be moved into an intermediate position and/or the pump 62 may be controlled with respect to its mode of operation and/or the cooling or heating device 61 may be switched on or off. By means of such structual elements, available to the person skilled in the art, it is possible for the temperature of the cylinder 1 always to be kept at a specific level. The numeral 66 designates a display device disposed in the transmission path from the temperature sensor to the regulating device 64.

A temperature control of this type may be provided in the case of particularly high accuracy requirements for several or for all cylinders of the printing attachment.

All the features mentioned in the above description or illustrated in the drawing should, insofar as the known state of the art permits, be regarded as being covered by the invention both individually and in combination.

I claim:

1. A printing attachment for rotary printing presses, comprising:

a frame having frame parts;

a first shaft;

holding devices in which the ends of the first shaft are detachably held for movement relative to the frame;

a first cylinder rotatably mounted on the first shaft by means of rolling bearings and interposed between the frame parts;

a first pair of support members supported by the first shaft at opposite ends respectively of the first cylinder so as to be independent of rotation of the first cylinder;

a second shaft detachably mounted on the frame parts;

a second cylinder rotatably mounted for cooperation with the first cylinder on the second shaft by means of rolling bearings and interposed between the frame parts;

a second pair of support members supported by the second shaft at opposite ends respectively of the second cylinder so as to be independent of rotation of the second cylinder, the first and second support members having respective outer supporting surfaces which face one another;

a third pair of support members having support surfaces disposed parallel to one another;

a power operated device for moving the holding devices to move the support surfaces on the first support members into contact with the support surfaces on respective second and third support members at a distance from one another in the manner of a two-point abutment and out of contact therewith to respectively engage and disengage the first cylinder;

and means for adjusting the position of the support surfaces of at least one pair of support members.

2. A printing attachment according to claim 1, wherein the first cylinder is a transfer cylinder and the second cylinder is a forming cylinder.

3. A printing attachment according to claim 1, wherein the first support members on the first cylinder have support surfaces disposed at a fixed distance from the axis of rotation of the cylinder and the second support members on the second cylinder have adjustable position support surfaces.

4. A printing attachment according to claim 1, wherein the third support members are associated with a third cylinder cooperatable with the first cylinder.

5. A printing attachment according to claim 4, wherein the third cylinder is rotatably mounted on a third shaft by means of rolling bearings, the third support members being supported by the third shaft.

6. A printing attachment according to claim 4, wherein the third cylinder is a forming cylinder.

7. A printing attachment according to claim 1, wherein the third support members have adjustable position support surfaces.

8. A printing attachment according to claim 1, wherein at least one pair of associated support members have support surfaces the positions of which are adjustable independently of one another.

9. A printing attachment according to claim 1, wherein setting apparatus is provided for angularly adjusting at least one support member about an axis of rotation, the setting apparatus comprising a support surface arranged eccentrically to the said axis of rotation.

10. A printing attachment according to claim 9, wherein the at least one support member is rotatably mounted on the shaft of a cylinder.

11. A printing attachment according to claim 9, wherein the setting apparatus comprises a worm and worm wheel drive, the worm wheel of which is connected rotationally rigidly to the support member.

12. A printing attachment according to claim 11, wherein the worm of the worm and worm wheel drive is supported on the side remote from the worm wheel on two pressure members which are acted upon by springs which seek to move them apart.

13. A printing attachment according to claim 1, wherein the ends of the first shaft are received in fork-shaped ends of respective pivot levers, which are mounted on the frame parts, the other ends of the pivot levers being connected to the power-operated device and the pivot points of the levers being intermediate the ends of the levers.

14. A printing attachment according to claim 1, wherein an impression cylinder is associated with the first cylinder, the impression cylinder having support members which are for bearing against the support members of the first cylinder, the impression cylinder being movable with respect to the first cylinder so as to engage and disengage the first cylinder.

15. A printing attachment according to claim 14, wherein the impression cylinder is rotatably mounted on a shaft by means of rolling bearings and the support members thereof are supported by its shaft.

16. A printing attachment according to claim 15, wherein the support members of the impression cylinder are mounted rotatably on the shaft of the impression cylinder.

17. A printing attachment according to claim 14, wherein the support members of the impression cylinder comprise support surfaces extending eccentrically to the turning centre of the cylinder and are angularly adjustable about the turning centre.

18. A printing attachment according to claim 14, comprising a control device for actuating a device for moving the first cylinder and a device for moving the impression cylinder one after the other in a predetermined sequence.

19. A printing attachment according to claim 1, wherein the rolling bearings of at least one cylinder are prestressed.

20. A printing attachment according to claim 1, wherein the rolling bearings of at least one cylinder include roller members which are disposed in a helical line at a distance from one another in a cylindrical cage.

21. A printing attachment according to claim 1, wherein flow paths for a medium are provided in at least one of the cylinders for controlling the temperature of the cylinder.

22. A printing attachment according to claim 21, wherein bores are provided in opposite ends of the said at least one cylinder, which bores open out in the vicinity of the respective bearing into an inner space between the cylinder and the shaft, and sealing means are provided at opposite ends of the said at least one cylinder.

23. A printing attachment according to claim 21, wherein a control or regulating device is provided for observing a predetermined temperature of the medium.

24. A printing attachment according to claim 23, wherein a separate control or regulating device is provided for each temperature-controllable cylinder.

* * * * *